US008522877B2

(12) United States Patent
Chambers et al.

(10) Patent No.: US 8,522,877 B2
(45) Date of Patent: Sep. 3, 2013

(54) SLIDING SLEEVE LOCKING MECHANISMS

(75) Inventors: Clay Chambers, Houston, TX (US); Jobby T. Jacob, Sugar Land, TX (US); Nicholas J. Clem, Houston, TX (US); Hugo Figueroa, Houston, TX (US); Travis E. Cochran, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 333 days.

(21) Appl. No.: 12/545,710

(22) Filed: Aug. 21, 2009

(65) Prior Publication Data

US 2011/0042107 A1 Feb. 24, 2011

(51) Int. Cl.
*E21B 34/06* (2006.01)
*E21B 34/00* (2006.01)

(52) U.S. Cl.
USPC ..... 166/323; 166/334.1; 166/373; 166/332.4

(58) Field of Classification Search
USPC ..... 166/323, 237, 386, 373, 332.1, 334.1, 166/332.4; 251/344, 103, 102, 106, 107, 251/108
See application file for complete search history.

(56) References Cited

U.S. PATENT DOCUMENTS 3,355,142 A * 11/1967 Castro et al. ..... 251/175
3,552,718 A * 1/1971 Schwegman ..... 251/291
3,696,868 A * 10/1972 Taylor, Jr. ..... 166/375
3,856,081 A * 12/1974 Canalizo ..... 166/123
4,062,406 A * 12/1977 Akkerman et al. ..... 166/323
4,176,717 A 12/1979 Hix ..... 166/289
4,349,071 A * 9/1982 Fish ..... 166/124
4,429,747 A * 2/1984 Williamson, Jr. ..... 166/321
4,520,870 A * 6/1985 Pringle ..... 166/317
4,624,315 A * 11/1986 Dickson et al. ..... 166/323
4,651,822 A * 3/1987 Johnston et al. ..... 166/117.5
4,796,705 A * 1/1989 Carmody et al. ..... 166/323
4,846,281 A * 7/1989 Clary et al. ..... 166/373
4,967,845 A * 11/1990 Shirk ..... 166/386
5,141,056 A * 8/1992 Tailby ..... 166/318
5,156,207 A * 10/1992 Haugen et al. ..... 166/142
5,167,284 A * 12/1992 Leismer ..... 166/374
5,183,115 A * 2/1993 Gano ..... 166/319
5,186,258 A * 2/1993 Wood et al. ..... 166/387
5,209,303 A * 5/1993 Barrington ..... 166/374
5,263,683 A * 11/1993 Wong ..... 251/145
5,518,073 A * 5/1996 Manke et al. ..... 166/240
6,112,816 A * 9/2000 Orzechowski et al. ..... 166/324
6,176,318 B1 * 1/2001 Drakeley et al. ..... 166/381
6,202,747 B1 * 3/2001 Lacy et al. ..... 166/120
6,513,595 B1 * 2/2003 Freiheit et al. ..... 166/332.4
6,551,030 B1 * 4/2003 Curry ..... 405/251
6,662,877 B2 * 12/2003 Patel ..... 166/386
6,684,958 B2 * 2/2004 Williams et al. ..... 166/386
7,108,071 B2 * 9/2006 Freiheit et al. ..... 166/373

(Continued)

*Primary Examiner* — Kenneth L Thompson
*Assistant Examiner* — Michael Wills, III
(74) *Attorney, Agent, or Firm* — Shawn Hunter

(57) ABSTRACT

Systems and methods for locking a sliding sleeve valve in an open position and/or a closed position to prevent inadvertent operation of the sleeve valve during other operations. A sliding sleeve valve locking assembly includes an outer housing defining a locking bore portion with a first locking groove formed therein, a sliding sleeve collet member having a collet finger with a tab shaped and sized to reside within the first locking groove. The sliding sleeve valve locking assembly also includes a collet locking member that is moveably disposed within the sliding sleeve collet member to selectively lock the sliding sleeve collet member within the locking bore portion.

18 Claims, 14 Drawing Sheets

(56) References Cited

U.S. PATENT DOCUMENTS

| | | | | |
|---|---|---|---|---|
| 7,201,232 | B2 * | 4/2007 | Turner et al. | 166/374 |
| 7,210,534 | B2 * | 5/2007 | Hayter et al. | 166/386 |
| 7,325,617 | B2 * | 2/2008 | Murray | 166/376 |
| 7,347,289 | B2 * | 3/2008 | Lee | 175/317 |
| 7,395,856 | B2 * | 7/2008 | Murray | 166/192 |
| 7,409,996 | B2 * | 8/2008 | Myerley et al. | 166/323 |
| 7,503,390 | B2 | 3/2009 | Gomez | 166/323 |
| 7,637,324 | B2 * | 12/2009 | Anderson et al. | 166/323 |
| 7,644,766 | B2 * | 1/2010 | Begley et al. | 166/312 |
| 7,748,462 | B2 * | 7/2010 | Reid | 166/323 |
| 7,854,268 | B2 * | 12/2010 | Lehr et al. | 166/386 |
| 2002/0066573 | A1 * | 6/2002 | Patel | 166/374 |
| 2002/0112862 | A1 * | 8/2002 | Patel | 166/386 |
| 2005/0098325 | A1 * | 5/2005 | Myerley et al. | 166/386 |
| 2005/0126787 | A1 * | 6/2005 | Gomez | 166/319 |
| 2005/0241711 | A1 * | 11/2005 | Sayers et al. | 138/89 |
| 2006/0037784 | A1 * | 2/2006 | Walter et al. | 175/71 |
| 2007/0163781 | A1 * | 7/2007 | Walker | 166/313 |
| 2008/0257558 | A1 * | 10/2008 | Darnell et al. | 166/373 |
| 2009/0014168 | A1 * | 1/2009 | Tips et al. | 166/73 |
| 2009/0194271 | A1 * | 8/2009 | Bissonnette et al. | 166/66 |
| 2011/0042107 | A1 * | 2/2011 | Chambers et al. | 166/386 |

* cited by examiner

SLIDING SLEEVE LOCKING MECHANISMS

BACKGROUND OF THE INVENTION

1. Field of the Invention

The present invention generally relates to the design of sliding sleeve valves. In particular aspects, the invention relates to systems and methods for securing a sliding sleeve valve in an open or closed position.

2. Description of the Related Art

Sliding sleeve valves are used extensively in hydrocarbon production wellbores. A sliding sleeve valve generally includes an outer housing that defines a central flowbore. The housing has one or more lateral fluid flow ports defined therein. A sleeve member is disposed within the flowbore and is axially moveable with respect to the housing between a first position, wherein the one or more lateral fluid ports is blocked, and a second position, wherein the one or more fluid ports is open.

In situations wherein a sleeve valve is incorporated into a production tubing string or other work string, wireline tools are often passed down through the center of those strings to conduct operations below the sleeve valve. These tools may inadvertently shift the sleeve within the sleeve valve, which is not desirable.

SUMMARY OF THE INVENTION

The devices and methods of the present invention provide systems and methods for locking a sliding sleeve valve in an open position and/or a closed position to prevent inadvertent operation of the sleeve valve during other operations.

In a preferred embodiment, a sliding sleeve mechanism includes an outer sleeve housing which defines an axial flowbore. One or more lateral fluid communication ports are disposed through the sleeve housing to permit fluid communication between the flowbore and the annulus radially surrounding the housing. A sliding sleeve member is slidingly disposed within the flowbore of the sleeve housing an is moveable between a first position, wherein the lateral fluid communication ports are unblocked by the sleeve to permit fluid communication between the annulus and the axial flowbore, and a second position, wherein fluid communication between the annulus and the flowbore is not permitted through the ports.

In various embodiments, the sliding sleeve mechanism is operably associated with a locking device which is operable to secure the sleeve member in open and/or closed positions. The locking device includes a housing bore portion with one or more locking grooves. The locking device also includes a sliding sleeve collet which is affixed to or integrally formed with the sliding sleeve member. The sliding sleeve collet includes a plurality of collet fingers with radially outwardly extending tabs which are shaped and sized to reside within the locking grooves of the housing bore portion.

The locking device also includes a collet locking member which resides radially within the sliding sleeve collet. In one embodiment, the collet locking member is a sleeve which includes an annular body with one or more collet fingers extending therefrom. The collet fingers have radially outwardly projecting tabs which releasably reside within one of a number of channels formed within an interior radial surface of the sliding sleeve collet. In this embodiment, a dog member is retained within an opening in the sliding sleeve collet. Movement of the collet locking member relative to the sliding sleeve collet will urge the dog member radially outwardly and into one of the surrounding locking grooves, thereby securing the sliding sleeve collet in place within the surrounding housing. When the dog member is moved radially inwardly, it operably interconnects the sliding sleeve collet and the collet locking member together.

A further embodiment is described wherein the sliding sleeve collet includes collet fingers which project in opposite axial directions. The collet locking member is an annular sleeve which can be moved axially within the sliding sleeve collet to positions wherein the body of the collet locking member retains one or more of the collet fingers of the sliding sleeve collet within a selected locking groove within the housing bore portion.

The locking device can be operated using a shifting tool which can engage portions of the collet locking member and move it axially with respect to the surrounding housing. The shifting tool preferably includes an engagement profile that selectively engages the collet locking member. As the collet locking member is moved within the housing, it also moves the surrounding sliding sleeve collet and the affixed sliding sleeve member between open and closed positions. Movement of the collet locking member with respect to the sliding sleeve collet will lock and unlock the sliding sleeve collet.

BRIEF DESCRIPTION OF THE DRAWINGS

The advantages and other aspects of the invention will be readily appreciated by those of skill in the art and better understood with further reference to the accompanying drawings in which like reference characters designate like or similar elements throughout the several figures of the drawings and wherein.

DETAILED DESCRIPTION OF THE PREFERRED EMBODIMENTS

As used in the discussion herein, the terms "up," "down," "upper," "lower," "above," "below," "upwardly," "downwardly," as well as other terms and their respective derivations, refer to relative, rather than absolute positions or orientations. Those of skill in the art will understand that various components and assemblies used within the described sliding sleeve locking assemblies may be reversed within a sliding sleeve valve and still provide desired function.

Figure 1:
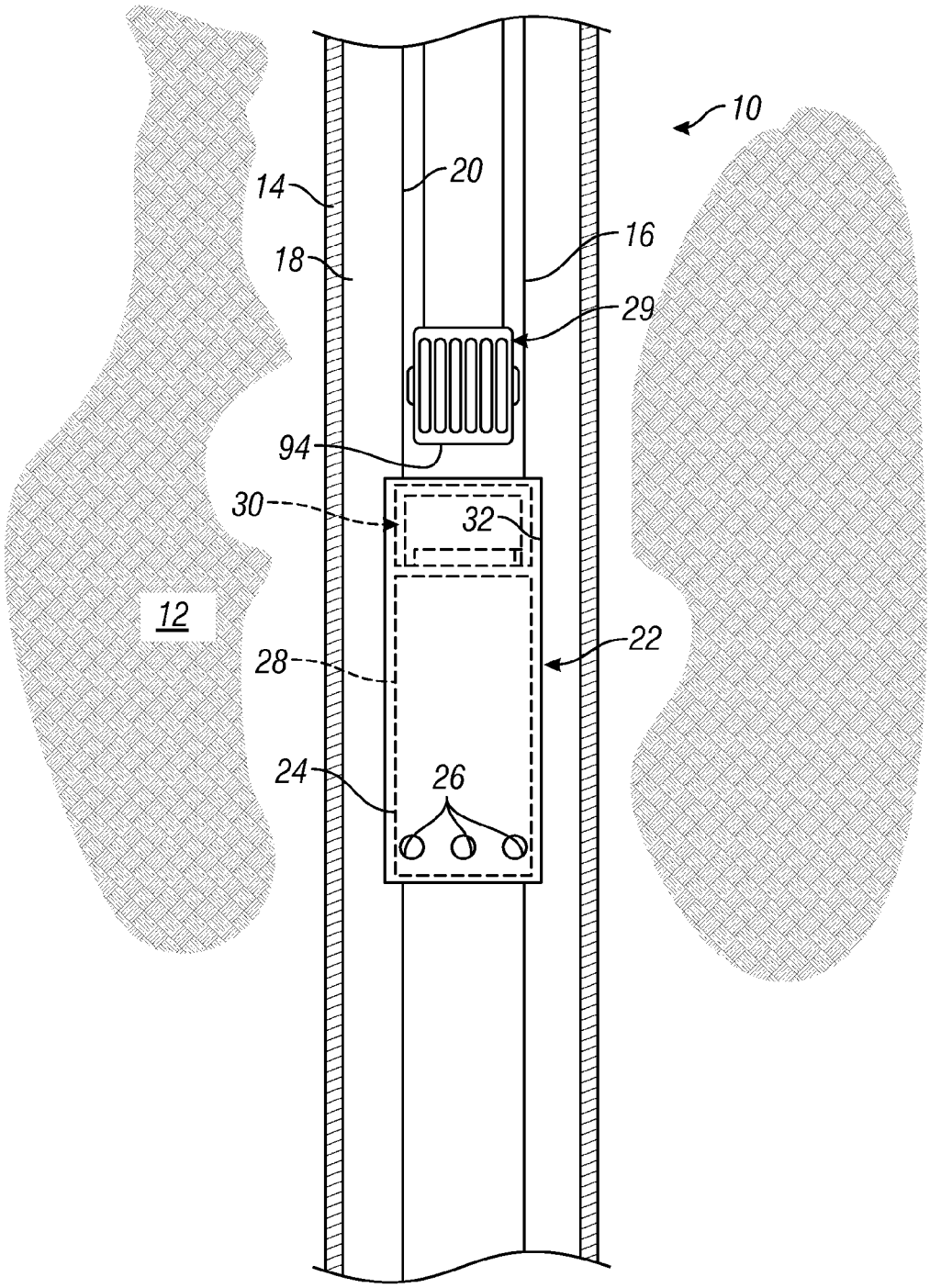
FIG. 1 is a side, partial cross-sectional view of a portion of a wellbore containing a hydrocarbon production string with a sliding sleeve assembly.

FIG. 1 illustrates a portion of an exemplary wellbore 10 that has been drilled through the earth 12 and which has been lined with casing 14. A production tubing string 16 is shown disposed within the wellbore 10. An annulus 18 is defined radially between the production tubing string 16 and the casing 14. The production tubing string 16 may be formed of a number of production tubing sections, of a type known in the art, which are interconnected to one another in an end-to-end fashion. The sections may be interconnected using threaded connections or by connecting collars or in other ways known in the art. Alternatively, the production tubing string 16 may be formed of coiled tubing, of a type known in the art. A central axial flowbore 20 is defined along the interior of the production tubing string 16.

A sliding sleeve valve 22 is incorporated into the production tubing string 16 in a manner known in the art. The sliding sleeve valve 22 is typically employed as a production nipple that can be selectively opened to permit production fluids within the wellbore 10 and from surrounding hydrocarbon-bearing formations to be flowed into the flowbore 20 of the production tubing string 16 and pumped to the surface of the wellbore 10. If desired, the sliding sleeve valve 22 may be axially isolated from other portions of the wellbore 10 by packers (not shown) which are set within the annulus 18 of the wellbore 10. The sliding sleeve valve 22 has a radially outer housing 24 with lateral fluid flow ports 26 disposed therethrough. The lateral ports 26 permit fluid communication between the annulus 18 and the interior of the housing 24 of the sleeve valve 22 so that fluid entering the valve 22 may be flowed to the surface of the wellbore 10 via the flowbore 20. The sliding sleeve valve 22 also includes a sliding sleeve member 28 which is slidably disposed within the housing 24 and is, as is well known, moveable between a first, closed position, wherein the sleeve member 28 blocks the ports 26 against fluid flow, and a second, open position, wherein fluid flow is permitted through the ports 26.

The sliding sleeve valve 22 incorporates a sliding sleeve valve locking assembly, generally indicated at 30, which is capable of securing the valve 22 in its closed and/or its open position. In general, the locking assembly includes a locking bore portion in an outer housing having one or more locking grooves formed within.

The locking assembly also includes a sliding sleeve collet, which is secured to or integrally formed with the sliding sleeve member 28, and a collet locking member which resides radially within the sliding sleeve collet. In preferred embodiments, the locking mechanism is actuated using a shifting tool 29, which is visible in FIG. 1 being disposed within the flowbore 20 of the production tubing string 16. The construction and operation of exemplary locking assemblies will be described in greater detail with respect to FIG. 2 et seq.

Figure 2:
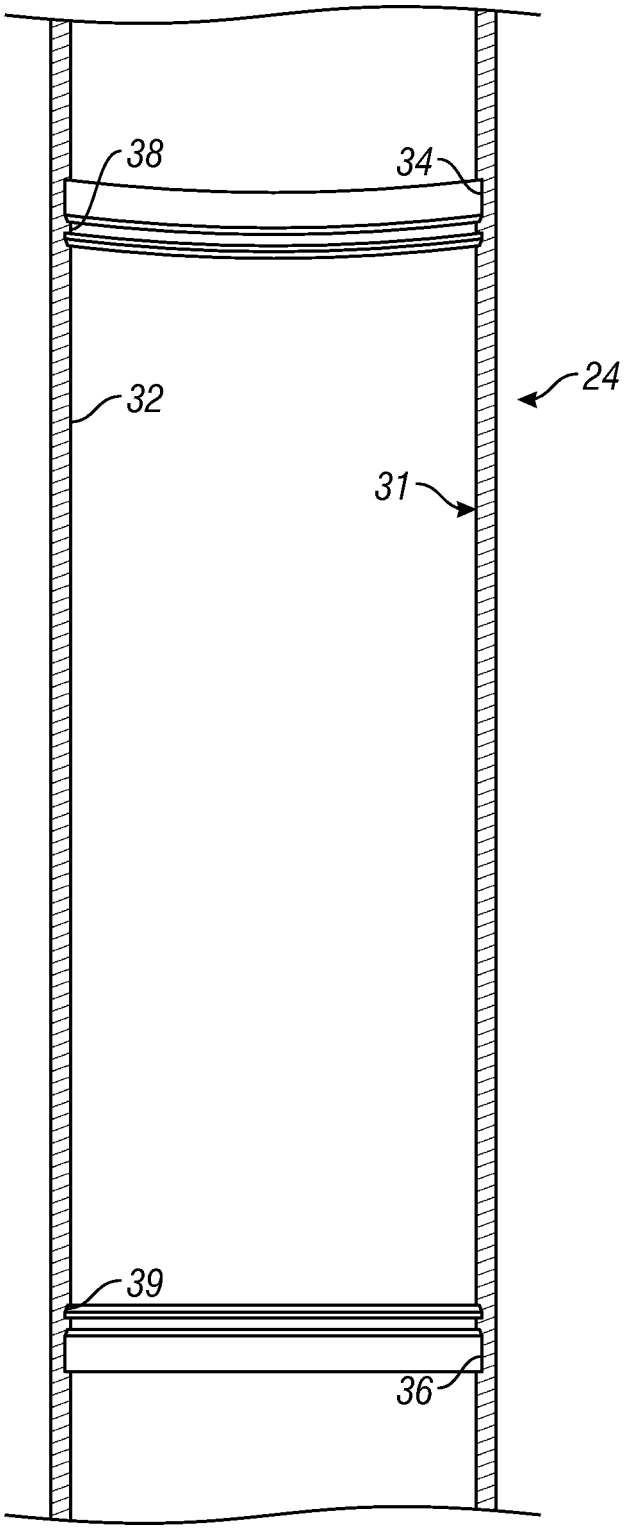
FIG. 2 is an enlarged, cross-sectional view of a locking bore portion of the sliding sleeve valve housing for an exemplary sliding sleeve assembly.

FIG. 2 depicts a locking bore portion 31 of the interior surface 32 of the sliding sleeve valve housing 24 apart from other components of the valve 22. The interior surface 32 has an upper latching groove 34 and lower locking groove 36 inscribed therein. Upper and lower secondary latching grooves 38, 39, respectively, are also inscribed within the interior surface 32.

Figure 3:
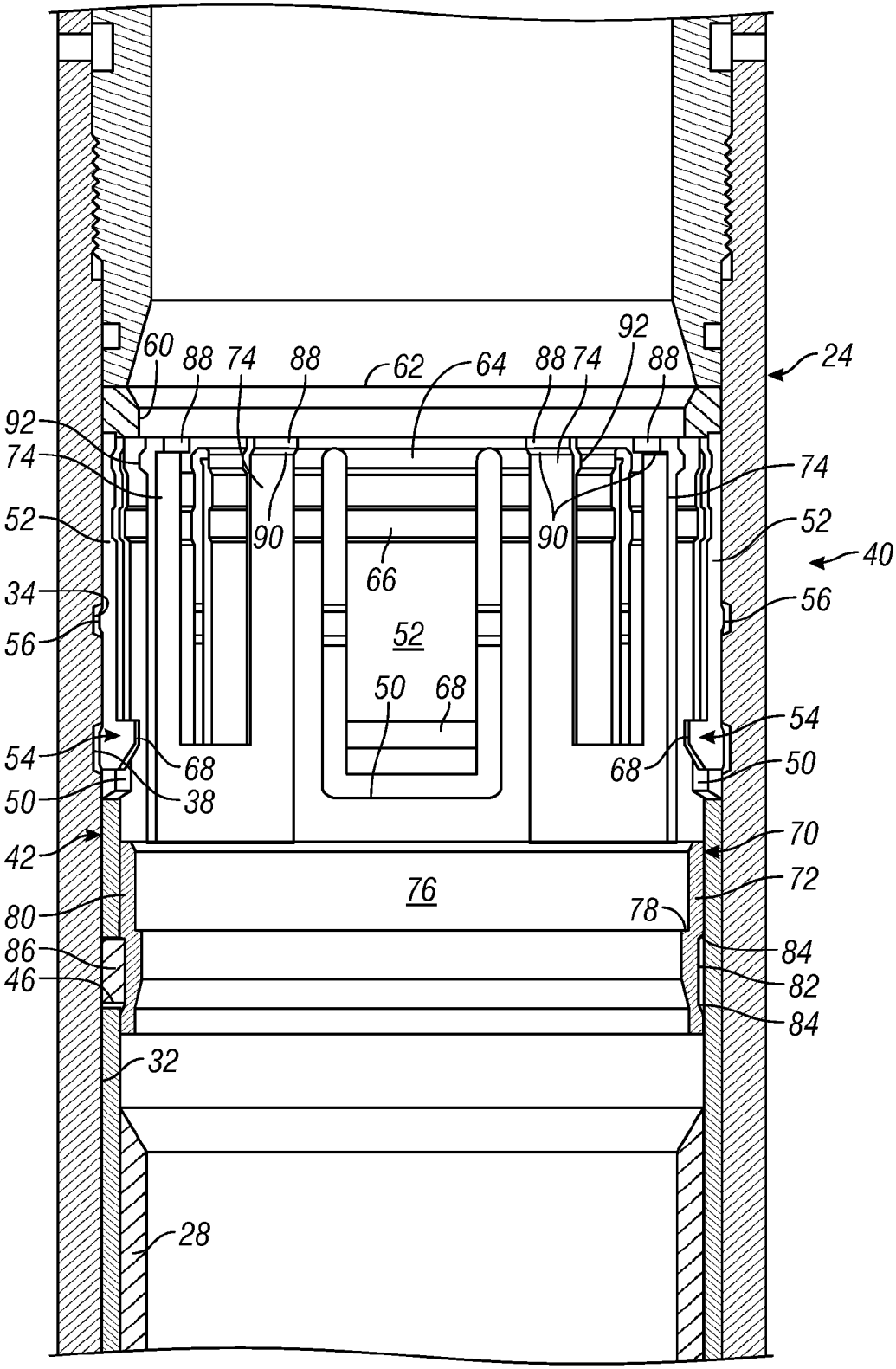
FIG. 3 is a side, cross-sectional view of an exemplary sliding sleeve locking assembly in accordance with the present invention, in an open-unlocked configuration.
Figure 6:
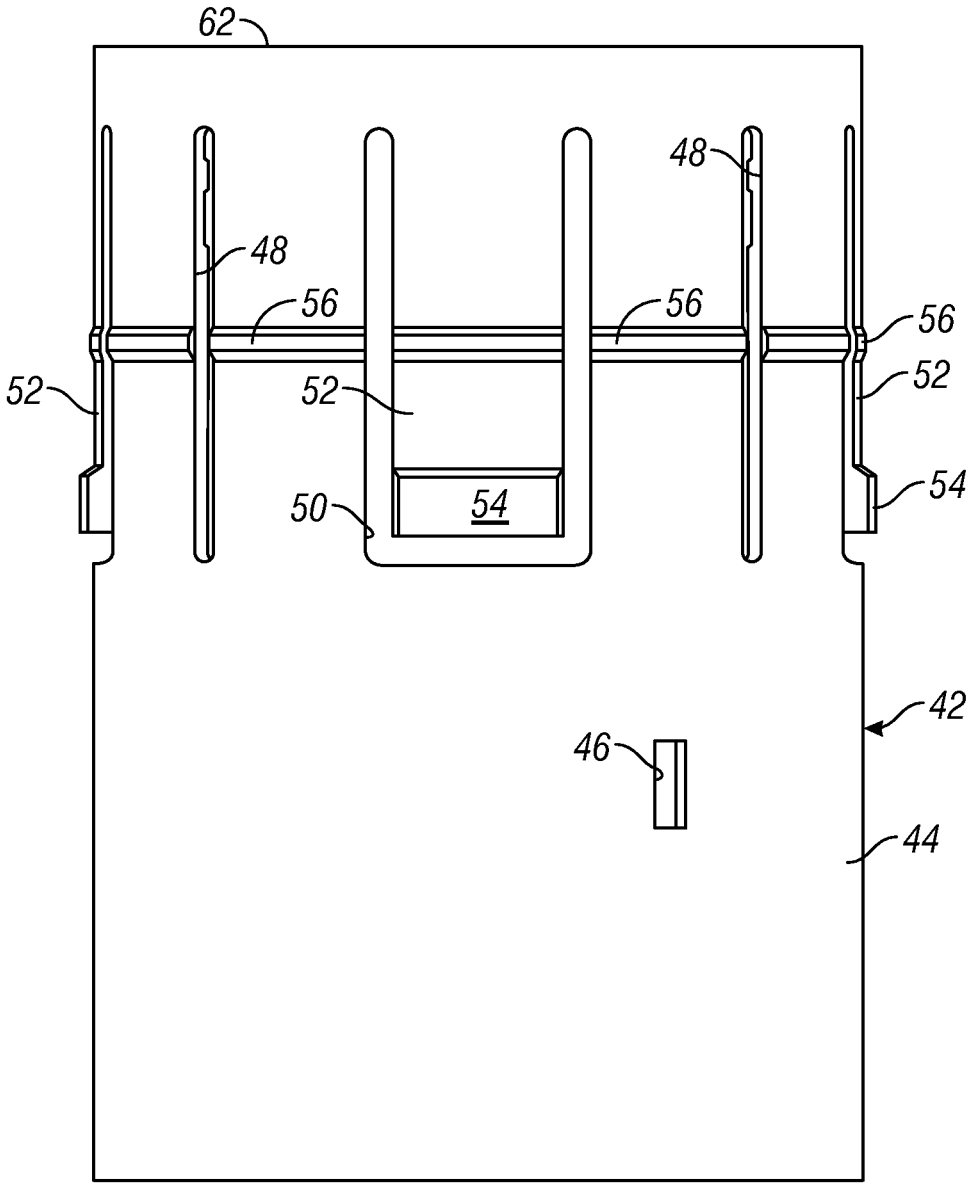
FIG. 6 is a side, external view of a sliding sleeve collet member apart from other components of the locking assembly.
Figure 7:
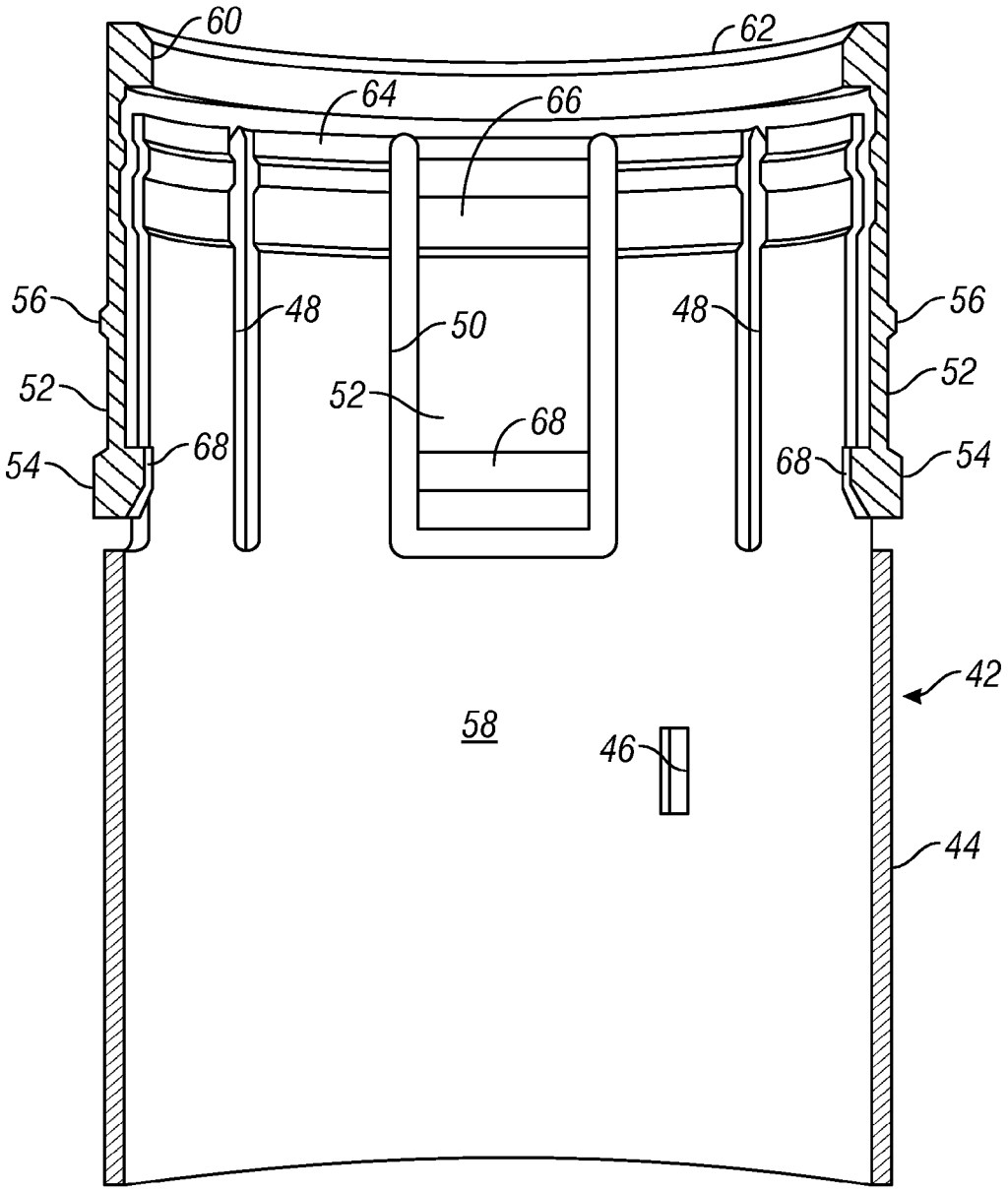
FIG. 7 is a side, cross-sectional view of the sliding sleeve collet member shown in FIG. 6.

FIG. 3 depicts an exemplary sliding sleeve locking assembly 40 which is located within the sliding sleeve valve housing 24. The locking assembly 40 includes a sliding sleeve collet member 42 which resides within the locking bore portion 31 of the housing 24. The sliding sleeve collet member 42 is depicted in greater detail in FIGS. 6 and 7, wherein it is shown apart from the other components of the locking assembly 40. The sliding sleeve collet member 42 has a generally cylindrical body 44 with a dog opening 46 disposed therethrough. Above the dog opening 46 are a plurality of vertically disposed slots 48 which are cut through the body 44. In addition, a number of generally U-shaped slots 50 are formed in the body 44 to define downwardly extending collet fingers 52. The lower end of each of the fingers 52 present radially outwardly extending tabs 54. In addition, a smaller radially outwardly extending tab 56 extends about the periphery of the body 44.

The interior radial surface 58 of the collet member 42 (shown in FIG. 7) has a radially inwardly extending flange 60 at the upper axial end 62. Upper and lower annular channels 64 and 66, respectively, are formed into the interior surface 58 below the flange 60. A radially inwardly directed tab 68 extends from the lower end of each finger 52.

Figure 8:
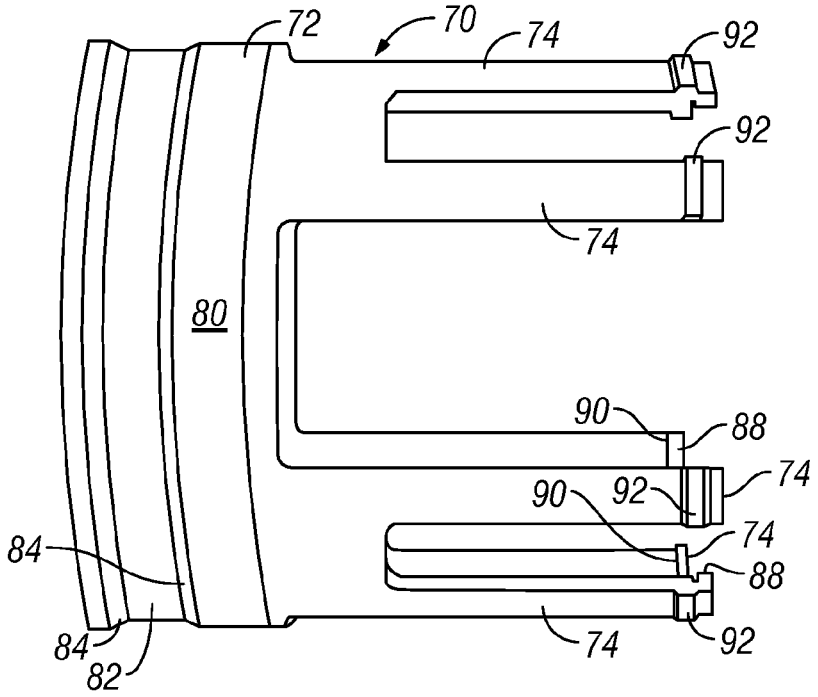
FIG. 8 is a side, external view of an exemplary collet locking member apart from the other components of the locking assembly.
Figure 9:
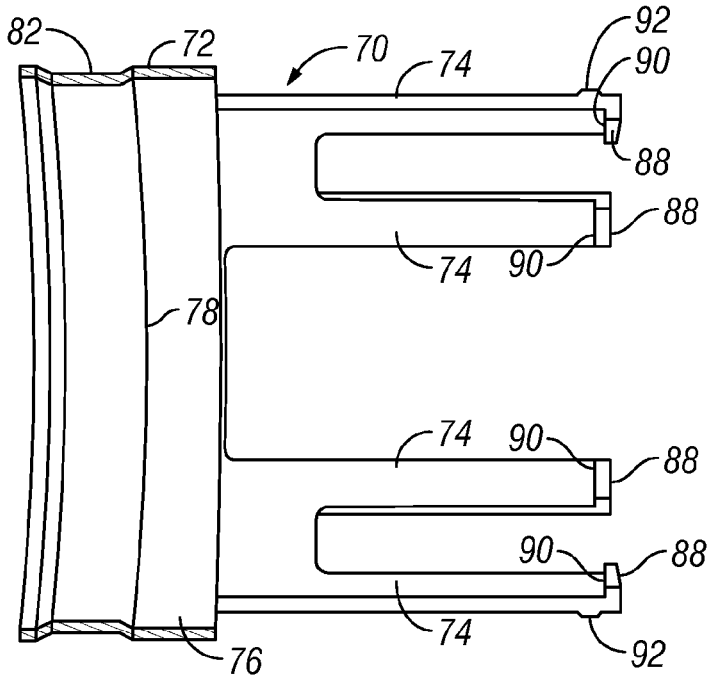
FIG. 9 is a side, cross-sectional view of the collet locking member shown in FIG. 8.

The locking assembly 40 also includes an annular collet locking member 70 which resides radially within the sliding sleeve collet member 42. FIGS. 8 and 9 depict the collet locking member 70 apart from the other components of the locking assembly 40. The collet locking member 70 includes a generally cylindrical base ring 72 with a plurality of axially extending collet fingers 74. The base ring 72 is corrugated so that the interior radial surface 76 of the base ring 72 presents an upwardly directed contact shoulder 78. The exterior radial surface 80 of the base ring 72 defines an annular dog recess 82 which is bounded by chamfered shoulders 84. A dog member 86 resides within the dog recess 82 and the dog opening 46 of the sliding sleeve collet member 42. The upper ends of the collet fingers 74 each present a radially inwardly directed flange 88 which presents a downwardly axially-facing shoulder 90. In addition, the collet fingers 74 each present a radially outwardly-projecting tab 92, which is shaped and sized to reside within the annular channels 64 or 66 in a complimentary manner.

Figure 10:
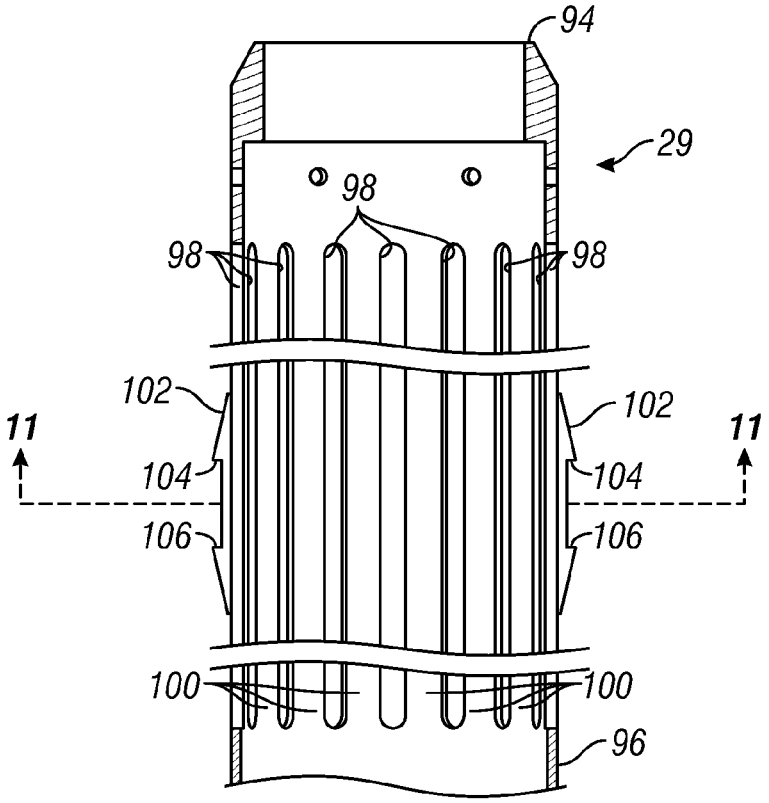
FIG. 10 is a side, cross-sectional view of an exemplary shifting tool for use in operating the sliding sleeve assembly of FIGS. 2-9.
Figure 11:
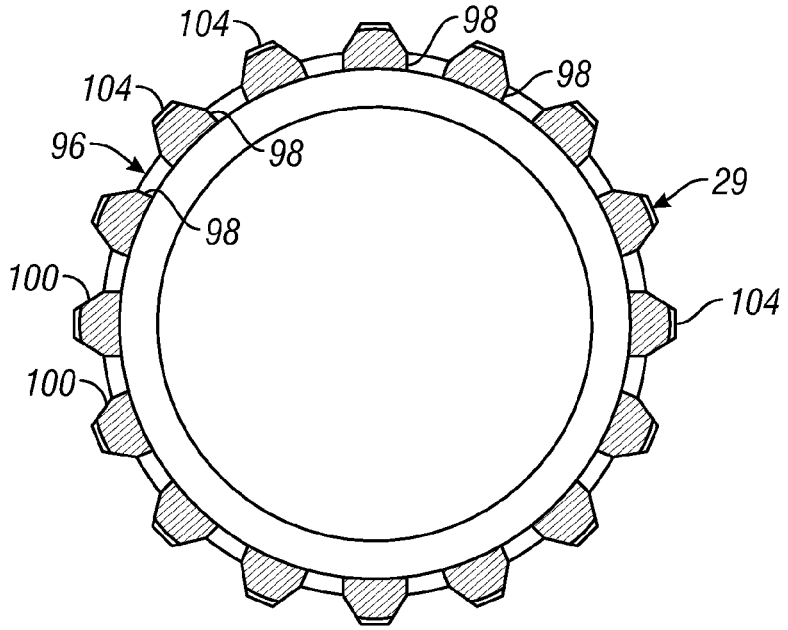
FIG. 11 is an axial cross-section taken along lines 11-11 in FIG. 10.

FIGS. 10 and 11 illustrate in greater detail the exemplary shifting tool 29 which can be used to actuate the locking assembly 40. The shifting tool 29 presents a bullnose leading end 94 and a generally cylindrical body 96 with a plurality of axial slots 98 disposed through the body 96 in an angularly spaced relation about the body 96 to form a series of substantially parallel ribs 100. Each rib 100 is provided with a radially outwardly extending engagement profile 102 which is shaped to present a first axially directed shifting shoulder 104 and a second shifting shoulder 106, which is directed in the opposite axial direction from the first shoulder 104.

In operation, the shifting tool 29 can be used to shift the sleeve member 28 between open and closed positions as well as actuate the locking assembly 40 between locked and unlocked configurations. When the locking assembly 40 is in a locked configuration, the sleeve member 28 is secured against inadvertent movement with respect to the surrounding housing 24, thereby making it unlikely that the sliding sleeve valve 22 will be inadvertently operated. FIG. 3 depicts the sleeve valve 22 in an open position so that fluid may enter the flowbore 20 of the production tubing string 16 from the annulus 18. Also, FIG. 3 shows the locking assembly 40 in an unlocked configuration. The tabs 54 of the sliding sleeve collet member 42 are located within the recess 38. The tabs 56 are located within the recess 34.

Figure 4:
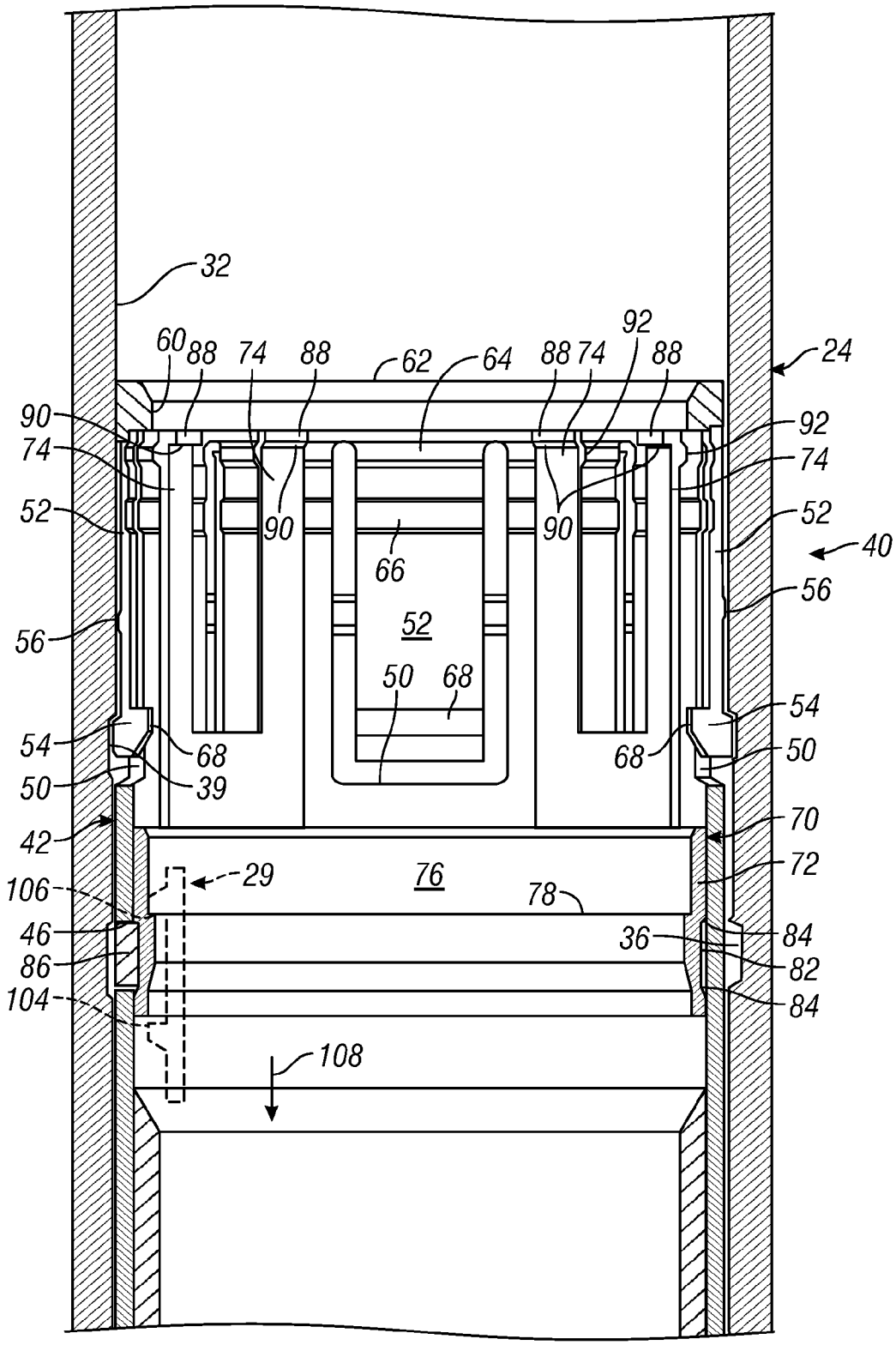
FIG. 4 is a side, cross-sectional view of the sliding sleeve locking assembly shown in FIG. 3, now in a closed-unlocked configuration.

In order to move the sleeve valve 22 and the locking assembly 40 from the open-unlocked position shown in FIG. 3 to the closed-unlocked configuration shown in FIG. 4, the shifting tool 29 is disposed into the flowbore 32 and moved downwardly until the shifting shoulder 106 of the shifting tool 29 engages the contact shoulder 78 of the collet locking member 70, as depicted in phantom in FIG. 4. Further movement of the shifting tool 29 in the direction of arrow 108 in FIG. 4 will move the collet locking member 70 axially in that direction. Movement of the collet locking member 70 in the direction of arrow 108 will also cause the sliding sleeve collet member 42 to be moved due to the presence of the dog member 86, which operably interlocks the sliding sleeve collet member 42 with the collet locking member 70. As the sliding sleeve collet member 42 is urged axially, the fingers 52 are deflected radially inwardly by sliding, ramping interaction between the outwardly extending tabs 54 and the angled side surfaces of the recess 38. The tabs 56 are also deflected inwardly out of the groove 34. As a result, the sliding sleeve collet member 42 is freed to move axially within the housing 24 until it reaches the closed-unlocked position shown in FIG. 4.

Figure 5:
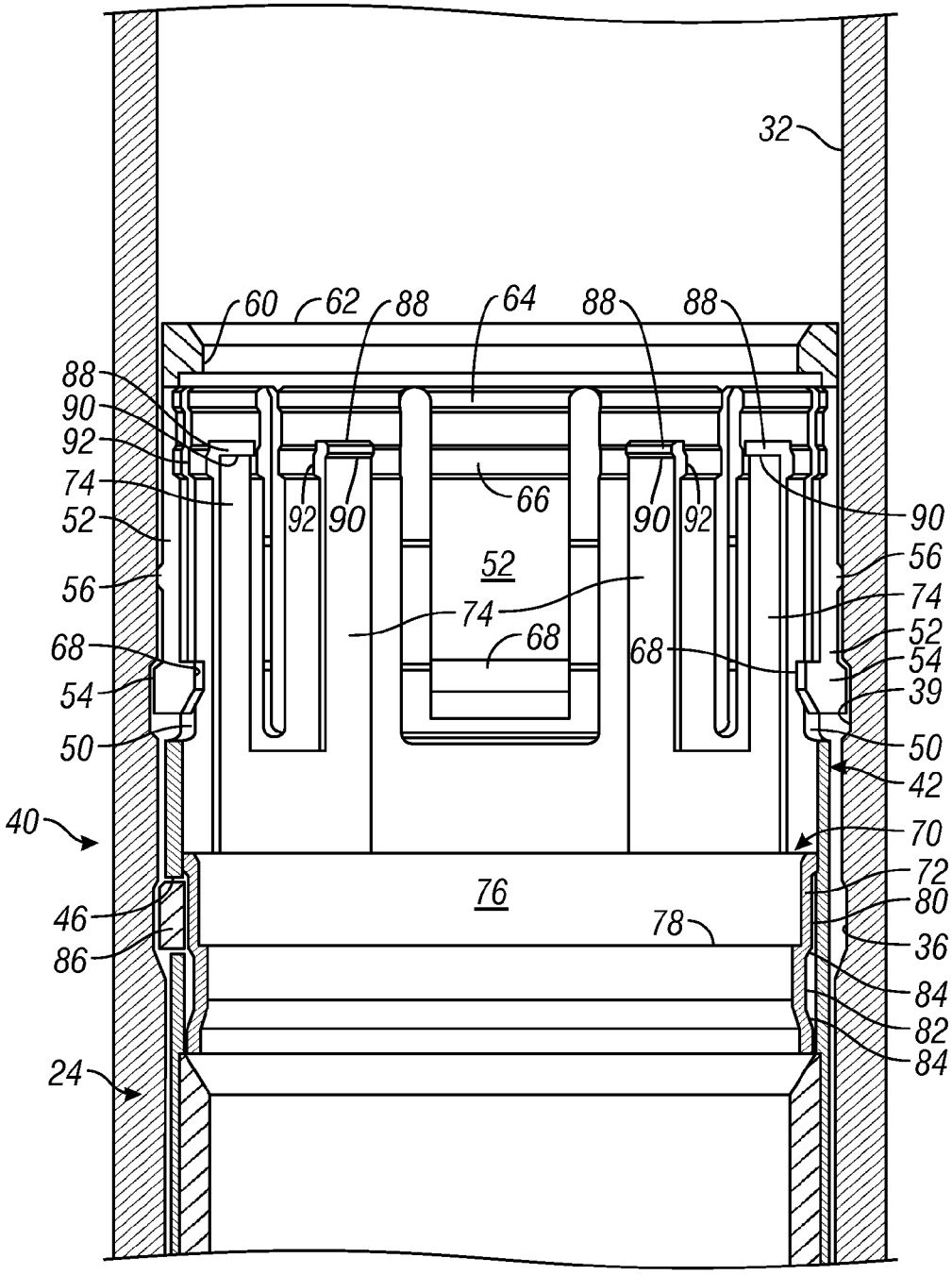
FIG. 5 is a side, cross-sectional view of the sliding sleeve locking assembly shown in FIGS. 3 and 4, now in a closed-locked configuration.

When the sliding sleeve collet member 42 is moved to the position shown in FIG. 4, the outwardly extending tabs 54 of the fingers 52 will snap into the latching groove 39. It is noted that, in this position, the dog member 86 is located adjacent to the lower groove 36. Further axial force upon the collet locking member 70 will cause the dog member 86 to be moved radially outwardly by sliding, ramping contact from chamfered shoulder 84 into the groove 36. As shown in FIG. 5, the radial outward movement of the dog member 86 will release the interconnection of the collet locking member 70 and the sliding sleeve collet member 42. The collet locking member 70 can now be moved axially with respect to the sliding sleeve collet member 42. The tabs 92 on collet fingers 74 will slide out of the upper annular channel 64 on the sliding sleeve collet member 42 and snap into the lower annular channel 66. This will secure the collet locking member 70 in a position wherein the exterior radial surface 80 of the base ring 72 retains the dog member 86 within the groove 36. This is the closed-locked position wherein the sliding sleeve valve 22 is secured in a closed position by the dog member 86 and the location of tabs 54 within the latching groove 39. It can be seen that, when the tabs 92 of the collet locking member 70 are located in the upper channel 64, this corresponds to an unlocked position wherein the dog member 86 can move radially inwardly to reside partially within the dog recess 82 in the collet locking member 70 and the sliding sleeve collet member 42 is unlocked and free to move with respect to the surrounding housing 24. Conversely, when the tabs 92 of the collet locking member 70 are located in the lower channel 66, this corresponds to a locked position wherein the dog member 86 is moved radially outwardly to partially reside within the groove 36 and the sliding sleeve collet member 42 is locked against movement with respect to the surrounding housing 24.

In order to shift the sliding sleeve valve 22 back out of the closed-locked position, to an open position the shifting tool 29 is moved axially within the sliding sleeve valve housing 24 and is moved until the shifting shoulder 104 of the shifting profile 102 engages the shoulder 90 of the collet locking member 70. The collet locking member 70 is pulled upwardly, and the tabs 92 of the collet locking member 70 are moved out of the lower channel 66 and back into the upper channel 64 of the sliding sleeve valve housing 24 (i.e., the position shown in FIG. 4). The dog member 86 is now freed to move radially inwardly and out of the locking groove 36 in the housing 24. Further upward movement of the shifting tool 29 will move the collet locking member 70 and the operably connected sliding sleeve collet member 42 upwardly in the housing 24. The locking assembly 40 will be returned to the open-unlocked position shown in FIG. 3.

Those of skill in the art will recognize that the sleeve valve 22 may be constructed so that the open and closed positions of the sliding sleeve valve 22 may be reversed from what is described herein. In other words, the sleeve valve 22 may be in an open position when the locking assembly 40 is in the lower position shown in FIGS. 4 and 5. Conversely, the sleeve valve 22 may be in a closed position when the locking assembly 40 is in the upper position shown in FIG. 3.

FIGS. 12-16 illustrate an alternative sliding sleeve locking assembly 120 which is constructed in accordance with the present invention and associated with a sliding sleeve valve 22, as described previously. The locking assembly 120 includes an outer housing 24' which defines a locking bore portion 31 having an upper latching groove 34' and lower latching groove 36' (visible in FIGS. 15 and 16). In this embodiment, grooves 38' and 39' are smaller grooves than latching grooves 34', 36'. The sliding sleeve collet member 42' is, like the sliding sleeve collet 42, operably affixed to the sleeve member 28 of the sliding sleeve valve 22. The sliding sleeve collet member 42' is provided with bi-directional collet fingers **52*a* and 52*b*. Collet fingers 52*a* extend upwardly toward the upper axial end 62 of the sliding sleeve collet member 42'. The collet fingers 52*b* extend downwardly away from the upper axial end 62. Tabs 54 extend radially outwardly from the distal end of each collet finger 52*a*, 52*b*, and inwardly-directed tabs 68 extend radially inwardly from the distal end of the collet fingers 52*a*, 52*b*. Minor tabs 56 also protrude radially outwardly from each of the collet fingers 52*a*, 52*b***.

The collet locking member 70' is generally cylindrically-shaped and resides radially within the sliding sleeve collet member 42'. The collet locking member 70' presents an exterior radial surface 122. Preferably, the exterior radial surface 122 presents upper and lower radially outward projections 124, 126. In addition, the collet locking member 70' has an interior radial surface 128 which presents an upwardly-facing engagement shoulder 130 and a downwardly-facing engagement shoulder 132.

Figure 12:
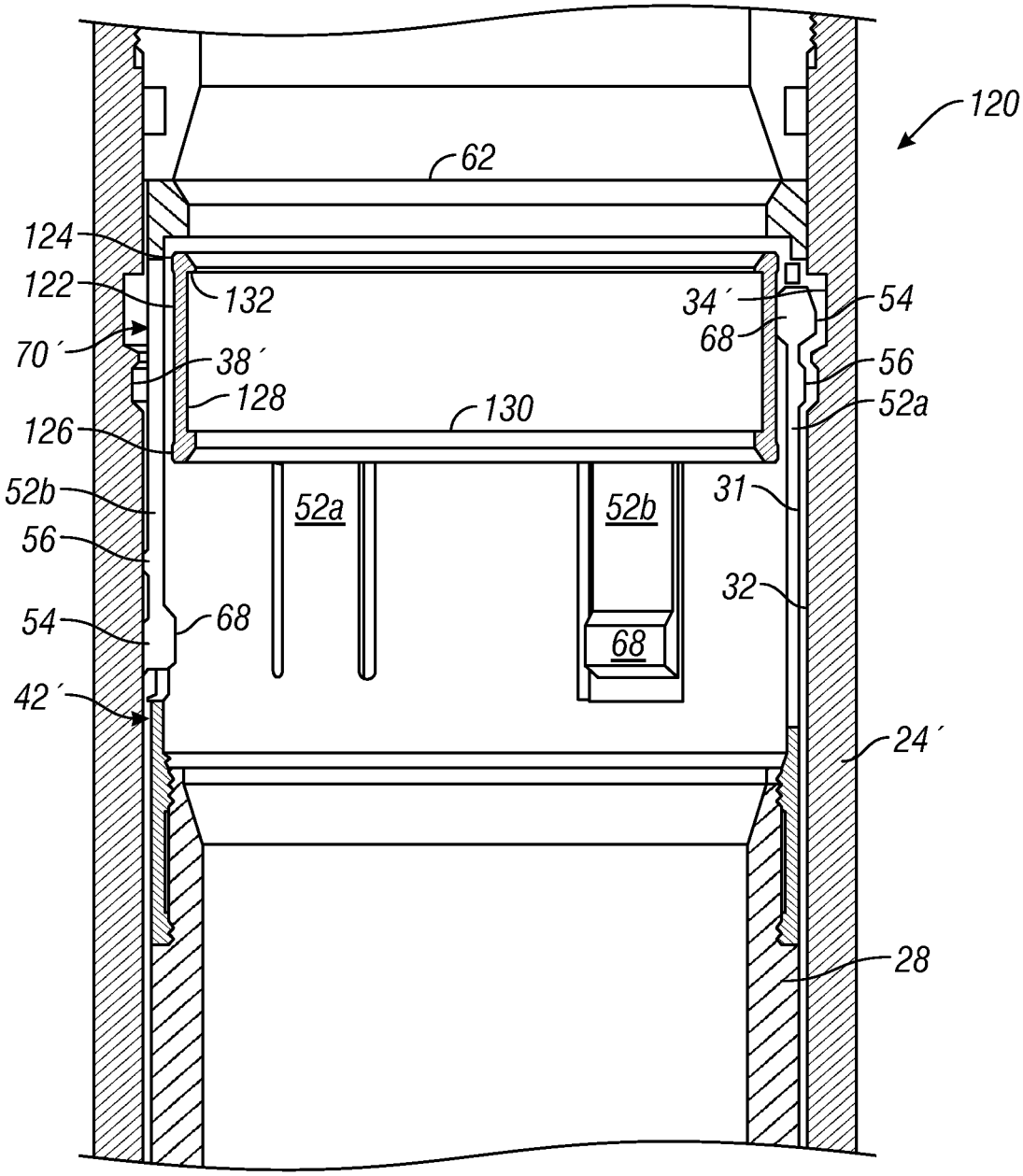
FIG. 12 is a side, cross-sectional view of an alternative sliding sleeve locking assembly, in an open-locked configuration.
Figure 13:
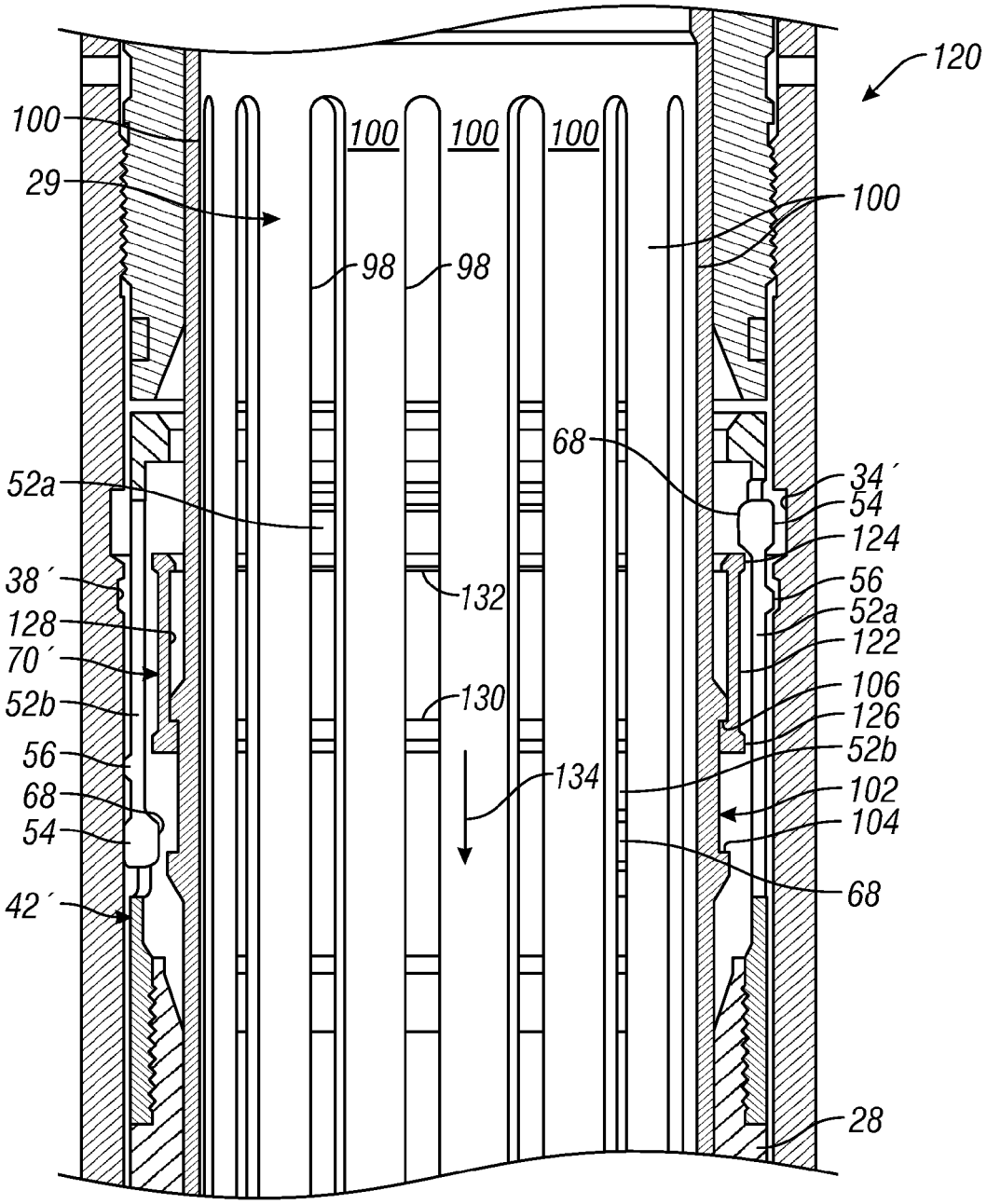
FIG. 13 is a side, cross-sectional view of the locking assembly shown in FIG. 12, now in an open-unlocked configuration.
Figure 16:
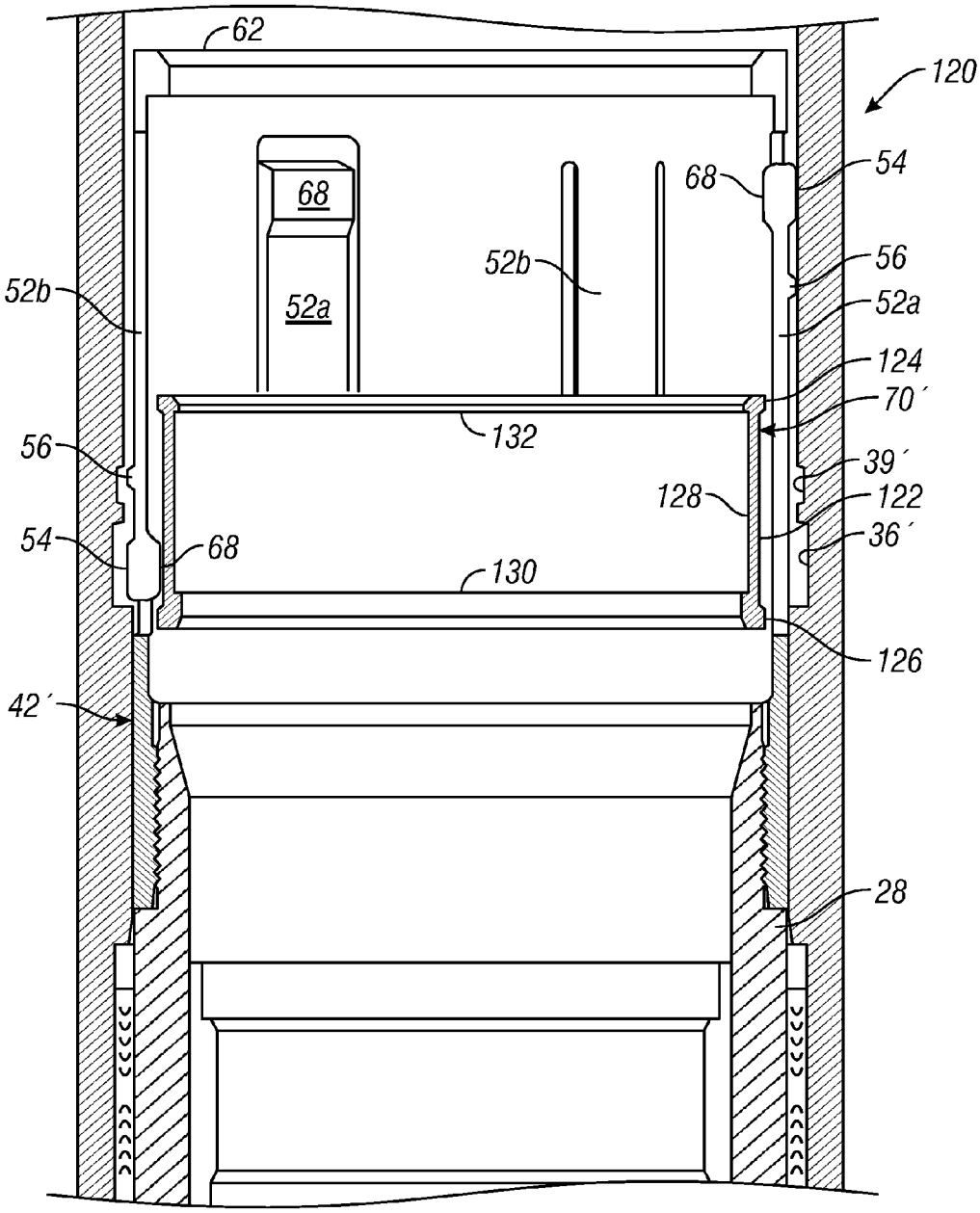
FIG. 16 is a side, cross-sectional view of the locking assembly shown in FIGS. 12-15, now in a closed-locked configuration.

In operation, the locking arrangement 120 can be moved by shifting tool 29 between an open-locked configuration, which is shown in FIG. 12 and a closed-locked configuration, which is depicted in FIG. 16. In FIG. 12, the sleeve member 28 is located within the surrounding housing 24' at a location which corresponds to an open condition for the sleeve valve 22. The affixed sliding sleeve collet member 42' is locked into position within the locking bore portion 31 of the housing 24' by the location of tabs 54 within latching groove 34'. The collet locking member 70' is located within the sliding sleeve collet member 42' such that the exterior radial surface 122 is in contact with the inwardly-protruding tabs 68 of each of the upwardly-extending collet fingers **52*a*. As a result, the outwardly projecting tabs 54 are locked within the groove 34'. In addition, the tabs 56 of each of the collet fingers 52***a* reside within the groove 38'. FIG. 13 shows that the shifting tool 29 has been moved into the locking arrangement 120 until the engagement shoulder 106 of the shifting tool 29 engages the engagement shoulder 130 of the collet locking member 70'. In FIG. 13, the shifting tool 29 has moved the collet locking member 70' downwardly, in the direction of arrow 134, so that the sliding sleeve collet member 42' is no longer locked into the groove 34'.

Figure 14:
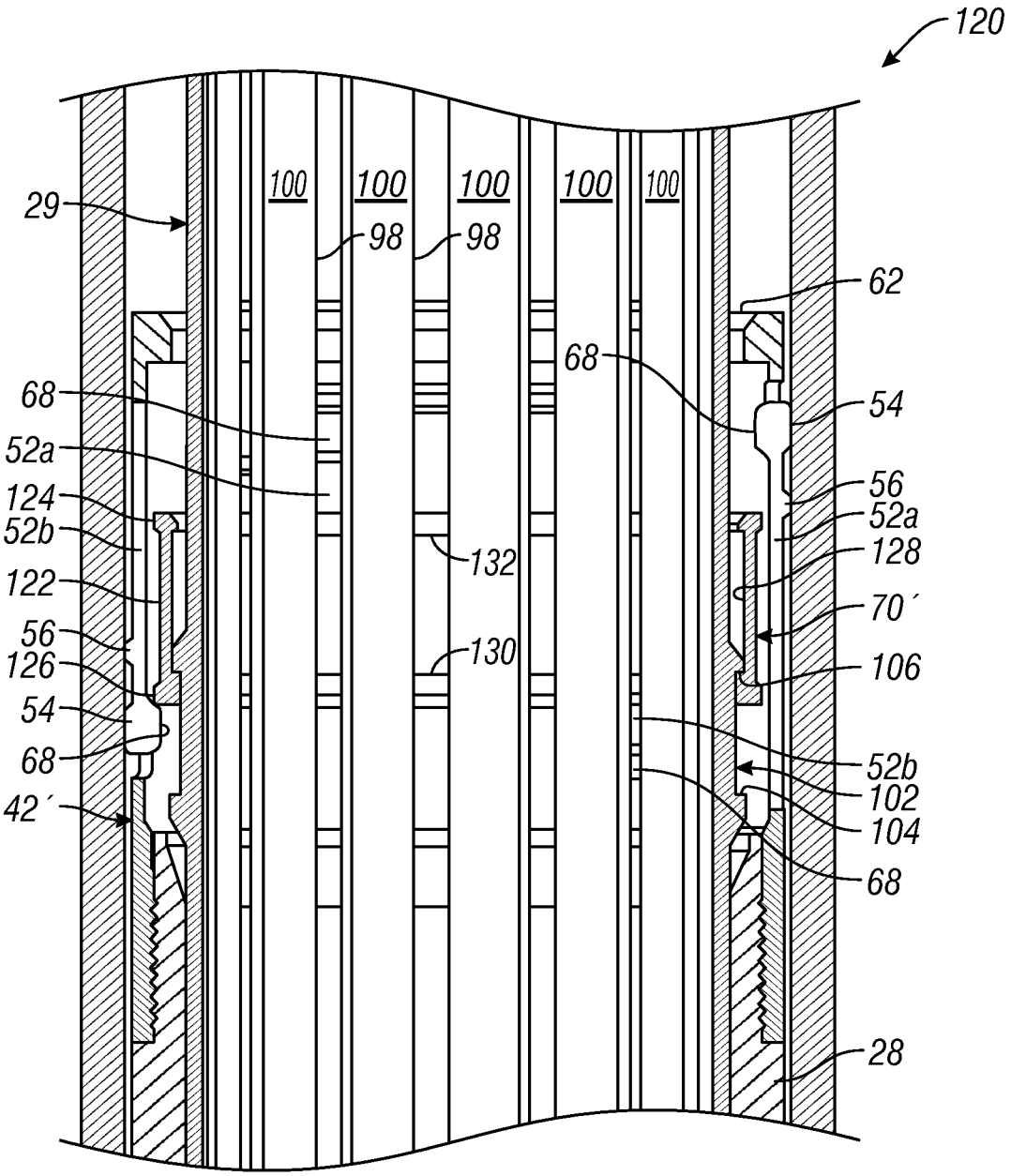
FIG. 14 is a side, cross-sectional view of the locking assembly shown in FIGS. 12-13, during shifting.

FIG. 14 shows the locking arrangement 120 at a further point during shifting wherein the projection 126 contacts the tab 68 of the sliding sleeve collet member 42' so that downward movement of the collet locking member 70' will also move the surrounding sliding sleeve collet member 42' downwardly.

Figure 15:
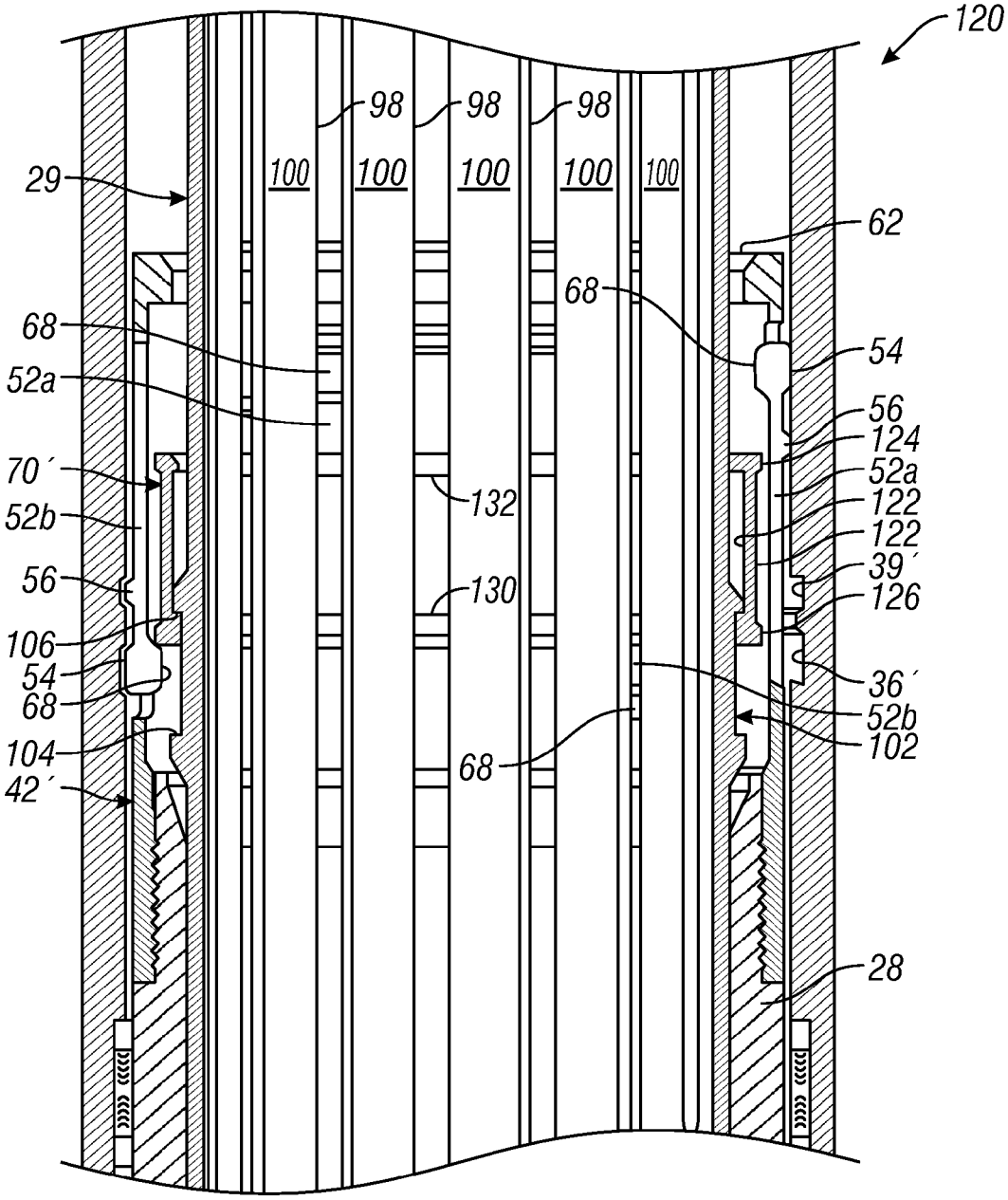
FIG. 15 is a side, cross-sectional view of the locking assembly shown in FIGS. 12-14, now in a closed-unlocked configuration.

In FIG. 15, the locking arrangement 120 has been shifted to a configuration wherein the sleeve member 28 now closes off fluid flow through the valve 22. In this configuration, the outwardly-projecting tabs 54 of each of the collet fingers 52*b* have become aligned with and snap outwardly into the lower latching groove 36' to locate the sliding sleeve collet member 42' at the proper location within the housing 24'. When this occurs, further downward movement of the sliding sleeve collet member 42' with respect to the surrounding housing 24' is stopped. As the shifting tool 29 is moved further downwardly, the collet locking member 70' will be moved to the position shown in FIG. 16 wherein the outer radial surface 122 contacts the tabs 68 to retain the outwardly extending tabs 54 within the groove 36'. The shifting tool 29 may now be withdrawn from the locking assembly 120 by moving it upwardly.

It should be understood that the locking arrangement 120 is capable of selectively securing the sliding sleeve valve 22 in an open position (i.e., the open-locked position of FIG. 12) as well as the closed position (i.e., the closed-locked position of FIG. 16).

Those of skill in the art will recognize that numerous modifications and changes may be made to the exemplary designs and embodiments described herein and that the invention is limited only by the claims that follow and any equivalents thereof.

What is claimed is:

1. A sliding sleeve valve locking assembly for use with a sliding sleeve valve having a) an outer housing defining a flowbore and a lateral flow port disposed through the housing; and b) a sliding sleeve member disposed within the flowbore and axially moveable within by a shifting tool disposed within a wellbore from a surface location between a first, open position wherein the lateral fluid flow port is not blocked by the sliding sleeve member and a second, closed position wherein the lateral fluid flow port is blocked by the sliding sleeve member, the locking assembly comprising:

the outer housing defining a locking bore portion having a first locking groove formed therein;

a sliding sleeve collet member that is moveably disposed within the outer housing, affixed to the sliding sleeve member and having a collet finger with a tab shaped and sized to reside within the first locking groove to correspond to one of the first or second positions for the sliding sleeve valve;

a collet locking member that is moveably disposed by the shifting tool within the sliding sleeve collet member to selectively lock the sliding sleeve collet member within the locking bore portion; and a second locking groove formed within the outer housing that is shaped and sized to permit the tab of the collet finger to reside within an corresponding to the other of the first or second positions for the sliding sleeve.

2. The sliding sleeve valve locking assembly of claim 1 further comprising a dog member that resides within a dog opening in the sliding sleeve collet member and is selectively moveable radially outwardly into a third locking groove in the outer housing to secure the sliding sleeve collet member within the outer housing.

3. The sliding sleeve valve locking assembly of claim 2 wherein the dog member is moved radially outwardly into the third locking groove by movement of the collet locking member within the sliding sleeve collet member.

4. The sliding sleeve valve locking assembly of claim 1 wherein the collet locking member presents an engagement shoulder which is engaged by the shifting tool to move the collet locking member with respect to the sliding sleeve collet member.

5. The sliding sleeve valve locking assembly of claim 1 wherein the collet locking member comprises an annular ring which locks the sliding sleeve collet member within the locking bore portion by retaining the collet finger tab within the first locking groove.

6. The sliding sleeve valve locking assembly of claim 1 further comprising:

a first channel formed radially within the sliding sleeve collet member; and wherein the collet locking member comprises:

a generally cylindrical base ring; and a collet finger axially extending from the base ring and presenting a radially projecting tab that is shaped and sized to reside within a locking channel in the sliding sleeve collet member n a locked configuration wherein the sliding sleeve collet member is locked against movement with respect to the surrounding housing.

7. The sliding sleeve valve locking assembly of claim 6 further comprising a second channel formed within the sliding sleeve collet member and shaped and sized to receive the tab of the collet locking member in an unlocked configuration wherein the sliding sleeve collet member is free to move with respect to the surrounding housing.

8. A sliding sleeve valve that is lockable in at least one of an open or a closed position, the sleeve valve comprising:

an outer housing defining a flowbore and a lateral fluid flow port disposed through the housing;

a sliding sleeve member disposed within the flowbore and axially moveable within by a shifting tool disposed within a wellbore from a surface location between a first, open position wherein the lateral fluid flow port is not blocked by the sliding sleeve member and a second, closed position wherein the lateral fluid flow port is blocked by the sliding sleeve member;

a locking assembly comprising;

a) a locking bore portion within the outer housing flowbore having a first locking groove formed therein;

b) a sliding sleeve collet member that is moveably disposed within the outer housing, affixed to the sliding sleeve member and having a collet finger with a tab shaped and sized to reside within the first locking groove to correspond to an open position for the sliding sleeve valve;

c) a collet locking member that is moveably disposed within the sliding sleeve collet member to selectively lock that collet finger tab in the first locking groove; and d) a second locking groove formed within the outer housing that is shaped and sized to permit the tab of the collet finger to reside within and corresponding to a closed position for the sliding sleeve valve.

9. The sliding sleeve valve of claim 8 further comprising a dog member that resides within a dog opening in the sliding sleeve collet member and is selectively moveable radially outwardly into a third locking groove in the outer housing to secure the sliding sleeve collet member within the outer housing.

10. The sliding sleeve valve of claim 9 wherein the dog member is moved radially outwardly into the third locking groove by movement of the collet locking member within the sliding sleeve collet member.

11. The sliding sleeve valve of claim 8 wherein the collet locking member presents an engagement shoulder which is engaged by the shifting tool to move the collet locking member with respect to the sliding sleeve collet member.

12. The sliding sleeve valve of claim 11 wherein the collet locking member comprises a gene rally cylindrical ring.

13. The sliding sleeve valve of claim 12 wherein the collet locking member further comprises a collet finger axially extending from the ring and presenting a radially projecting tab that is shaped and sized to reside within a locking channel in the sliding sleeve collet member in a locked configuration so that the sliding sleeve collet member is locked against movement with respect to the surrounding housing.

14. The sliding sleeve valve of claim 13 further comprising a second channel formed within the sliding sleeve collet member and shaped and sized to receive the tab of the collet locking member in an unlocked configuration wherein the sliding sleeve collet member is free to move with respect to the surrounding housing.

15. A method of selectively locking a sliding sleeve valve into an open/closed configuration, the method comprising the steps of:

providing the sliding sleeve valve having:

a) an outer housing defining a flowbore and a lateral fluid flow port disposed through the housing;

b) a sliding sleeve member disposed within the flowbore and axially moveable within between a first, open position wherein the lateral fluid flow port is not blocked by the sliding sleeve member and a second, closed position wherein the lateral fluid flow port is blocked by the sliding sleeve member;

securing the sliding sleeve member to a sliding sleeve collet member;

locating the sliding sleeve member at a desired location within the outer housing by latching a tab of the sliding sleeve collet member within either of a first locking groove or a second locking groove within the flowbore, each of the locking grooves corresponding to one of either the first, open position or the second, closed position; and locking the sliding sleeve member at the desired location by urging a dog member radially outwardly and into a locking groove in the housing.

16. The method of claim 15 wherein the dog member is urged radially outwardly from the sliding sleeve collet member associated with the sliding sleeve member.

17. The method of claim 15 wherein the step of urging a dog member radially outwardly further comprises moving a collet locking member axially with respect to the sliding sleeve collet member.

18. The method of claim 17 wherein the collet locking member is moved by a shifting tool having a shifting profile shaped and sized to engage the collet locking member for shifting it.

* * * * *

UNITED STATES PATENT AND TRADEMARK OFFICE

CERTIFICATE OF CORRECTION

PATENT NO. : 8,522,877 B2
APPLICATION NO. : 12/545710
DATED : September 3, 2013
INVENTOR(S) : Chambers et al.

It is certified that error appears in the above-identified patent and that said Letters Patent is hereby corrected as shown below:

In the Claims

At column 9, line 16, the term "gene rally" should be -- generally --.

Signed and Sealed this
Fifteenth Day of October, 2013

Teresa Stanek Rea

Teresa Stanek Rea
*Deputy Director of the United States Patent and Trademark Office*